US009092005B2

(12) United States Patent
Yamamoto

(10) Patent No.: US 9,092,005 B2
(45) Date of Patent: Jul. 28, 2015

(54) IMAGE FORMING APPARATUS WITH A REMOVABLE DRUM UNIT

(71) Applicant: KYOCERA DOCUMENT SOLUTIONS INC., Osaka (JP)

(72) Inventor: Koju Yamamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 91 days.

(21) Appl. No.: 13/954,095

(22) Filed: Jul. 30, 2013

(65) Prior Publication Data

US 2014/0029979 A1 Jan. 30, 2014

(30) Foreign Application Priority Data

Jul. 30, 2012 (JP) ..... 2012-168302

(51) Int. Cl.
*G03G 15/00* (2006.01)
*G03G 21/16* (2006.01)

(52) U.S. Cl.
CPC ..... *G03G 21/1671* (2013.01); *G03G 21/1647* (2013.01); *G03G 21/1676* (2013.01)

(58) Field of Classification Search
CPC ..... G03G 21/1671; G03G 21/1647; G03G 21/1676
USPC ..... 399/110, 111, 121, 116, 119
See application file for complete search history.

(56) References Cited

U.S. PATENT DOCUMENTS

2007/0189804 A1* 8/2007 Yasumitsu ..... 399/111

FOREIGN PATENT DOCUMENTS

| | | | | | |
|---|---|---|---|---|---|
| JP | U-S62-149046 | A | | 9/1987 | |
| JP | 01101561 | A | * | 4/1989 | ..... G03G 15/00 |
| JP | 2002-278424 | A | | 9/2002 | |
| JP | 2004258693 | A | * | 9/2004 | ..... G03G 21/16 |
| JP | 2005-157187 | A | | 6/2005 | |

OTHER PUBLICATIONS

English Abstract and Translation for JP 2002-278424 A, published Sep. 27, 2002.
English language Abstract and Machine Translation for JP U-S62-149046 A, published Sep. 21, 1987.
English language Abstract and Machine Translation for JP 2005-157187 A, published Jun. 16, 2005.

* cited by examiner

*Primary Examiner* — G. M. Hyder
(74) *Attorney, Agent, or Firm* — NDQ&M Watchstone LLP

(57) ABSTRACT

An image forming apparatus of the present disclosure includes a drum unit, a development unit, a stopper, a pressing unit and an interlock device. The development unit includes a development roller that develops a toner image on the photoconductor drum. The drum unit and the development unit can be removed from the main body of the apparatus. The stopper is freely moved between a restriction position where the removal of the drum unit is restricted and a release position where the restriction of the removal of the drum unit is released. The pressing unit is freely moved between a pressing position where the development roller is pressed onto the photoconductor drum and a pressing release position where the development roller is separated from the photoconductor drum such that the pressing is released. The interlocking device interlocks the movements of the stopper and the pressing unit.

2 Claims, 12 Drawing Sheets

IMAGE FORMING APPARATUS WITH A REMOVABLE DRUM UNIT

This application is based upon and claims the benefit of priority from the corresponding Japanese Patent Application No. 2012-168302 filed on Jul. 30, 2012, the entire contents of which are incorporated herein by reference.

BACKGROUND

The present disclosure relates to image forming apparatuses such as copying machines, printers and facsimile machines.

There are some image forming apparatuses in which an electrostatic latent image is formed on an image carrying member such as a photoconductor drum, the electrostatic latent image is developed with toner and the developed toner image is transferred to a predetermined sheet member. In the image forming apparatus as described above, in general, the photoconductor drum and its peripheral devices are formed into one or a plurality of units, they are designed to be freely removed and thus a maintenance operation, an assembly operation and the like are efficiently performed.

For example, an image forming apparatus is known in which a process unit including a photoconductor stored within a housing and a plurality of development units that develop the latent image of the photoconductor is configured such that the process unit can be removed in a direction intersecting the direction in which recording paper is transported. In this image forming apparatus, the entire process unit including the photoconductor and the development units is removed from the apparatus main body, and thereafter each of the development units can be removed and inserted.

Incidentally, in recent years, medium-sized and large-sized image forming apparatuses have been widely used in general offices, and general users may perform a unit replacement operation. However, in the conventional technology described above, when the development unit needs to be replaced due to the life of the product or a failure, it is necessary to perform a replacement operation in the following replacement order: the entire process unit including the photoconductor drum is first removed, and thereafter the development unit is removed and inserted.

Hence, when an operator who is not familiar with the configuration of the apparatus performs the replacement operation, the operator is confused with which unit needs to be first removed in order to replace a specific unit. As described above, in the maintenance and the operation of dealing with the failure that have been conventionally performed, the unit replacement operation is bothersome, and this disadvantageously causes an increase in downtime, the expansion of an operating area and the like.

The present disclosure is made in view of the foregoing problem; an object of the present disclosure is to provide an image forming apparatus that can easily and efficiently perform a unit replacement operation.

SUMMARY

An image forming apparatus according to an aspect of the present disclosure includes a drum unit, a development unit, a stopper, a pressing unit and an interlocking device. The drum unit includes a photoconductor drum. The development unit includes a development roller that develops a toner image on the photoconductor drum. The drum unit and the development unit can be removed from the main body of the apparatus. The stopper is freely moved between a restriction position where the removal of the drum unit is restricted and a restriction release position where the restriction of the removal of the drum unit is released. The pressing unit is freely moved between a pressing position where the development roller is pressed onto the photoconductor drum and a pressing release position where the development roller is separated from the photoconductor drum such that the pressing is released. The interlocking device interlocks the movements of the stopper and the pressing unit.

Other objects of the present disclosure and specific advantages obtained by the present disclosure will be obvious from the description of an embodiment discussed below.

DETAILED DESCRIPTION

An embodiment of an image forming apparatus according to the present disclosure will be described below with reference to accompanying drawings. In the following description, an XYZ orthogonal coordinate system is set, and the positional relationship between individual members may be discussed with reference to the XYZ orthogonal coordinate system. It is assumed that a predetermined direction within a horizontal plane is an X axis direction, a direction perpendicular to the X axis direction within the horizontal plane is a Y axis direction and a direction (that is, a vertical direction) perpendicular to each of the X axis direction and the Y axis direction is a Z axis direction.

(Schematic Configuration of the Image Forming Apparatus)

Figure 1:
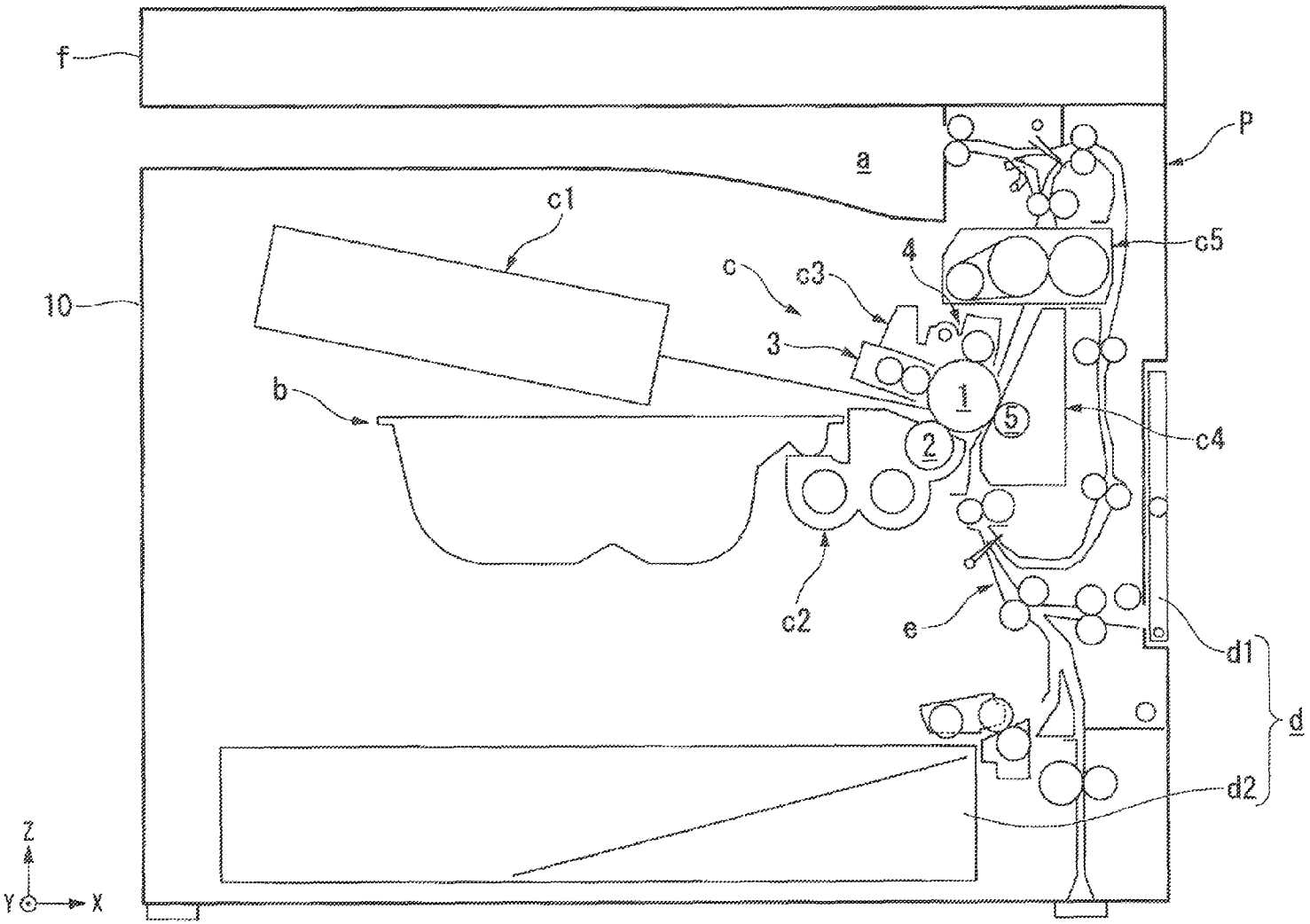
FIG. 1 is a schematic diagram of the configuration of a copying machine in an embodiment of the present disclosure.

FIG. 1 is a schematic diagram of the configuration of a copying machine P in the embodiment of the present disclosure. The copying machine (image forming apparatus) P includes a discharge section a, a toner storage section b, an image formation section c and a sheet supply section d. In the copying machine P, a transport section e is provided so as to extend from the sheet supply section d located in a lower portion to the discharge section a located in an upper portion. In the copying machine P, on the discharge section a, a scanner section f that reads an original document is provided.

The discharge section a is configured such that a sheet (sheet member) having a predetermined image formed is discharged through the transport section e into the discharge section a. The bottom surface of the discharge section a is inclined, and thus it is possible to stack a plurality of ejected sheets with one ends aligned.

The toner storage section b is formed with, for example, the toner container of a black toner (BK), and is configured such that the toner can be supplied to a development unit c2 of the image formation section c.

The image formation section c includes a laser scanning unit c1, the development unit c2, a drum unit c3, a transfer unit c4 and a fixing unit c5.

As with a known laser scanning unit, the laser scanning unit c1 includes: a light beam generator that generates laser light; a polygon mirror that scans the light beam applied from the light beam generator; and a f0 lens that forms, with the light beam scanned by the polygon mirror, an image on a photoconductor drum (image carrying member) 1, which will be described later (all of which are not shown).

The development unit c2 supplies the toner to the photoconductor drum 1 to develop an electrostatic latent image formed on the circumferential surface of the photoconductor drum 1, and includes a development roller 2 that is arranged opposite the circumferential surface of the photoconductor drum 1 in its radial direction.

The drum unit c3 includes the photoconductor drum 1 in which the laser scanning unit c1 is used to produce the electrostatic latent image on the circumferential surface of that, and in which a toner image is formed with the toner supplied from the toner storage section b to the development unit c2.

Around the photoconductor drum 1, a charger 3 that brings its circumferential surface into the charged state, a cleaner 4 that removes the toner left on the circumferential surface after the transfer and the like are arranged opposite the photoconductor drum 1. The charger 3, the cleaner 4 and the like of the present embodiment are formed, together with the photoconductor drum 1, as the drum unit c3, into a removable unit.

The transfer unit c4 includes a transfer roller 5 that is arranged opposite the circumferential surface of the photoconductor drum 1 in its radial direction. The transfer roller 5 is provided so as to press the photoconductor drum 1.

Hence, as the photoconductor drum 1 is driven to rotate, the transfer roller 5 can rotate. When a predetermined sheet member, for example, the sheet, is transported through the transport section e, the transfer roller 5 can be rotated with the sheet interposed between the transfer roller 5 and the photoconductor drum 1, and the sheet can be transported to the side of the fixing unit c5.

The fixing unit c5 is provided in part of the transport section e on the downstream side with respect to the place where the transfer unit c4 is provided, and is formed with a pair of rollers arranged to be able to sandwich the sheet transported along the transport section e. The fixing unit c5 is configured such that the toner image on the sheet transferred with the transfer unit c4 is pressurized and heated with the pair of rollers and thus the toner image can be fixed to the sheet.

The sheet supply section d includes a paper feed tray d1 which is provided to be freely opened and closed with respect to the apparatus main body 10 and a paper feed cassette d2 which is provided to be freely removed from the apparatus main body 10. The sheet supply section d is configured such that the sheets can be supplied one by one from the paper feed tray d1 or the paper feed cassette d2 to the transport section e.

The transport section e is provided to extend from the sheet supply section d located in a lower portion to the discharge section a located in an upper portion, and is formed with a plurality of transport rollers and guide plates. The transport section e is configured such that the sheets supplied from the sheet supply section d can be transported one by one to the discharge section a.

In the copying machine P configured as described above, the laser light corresponding to image data is applied from the laser scanning unit c1 to the photoconductor drum 1 to form the electrostatic latent image, and the toner image is developed with the supplied toner. Then, the toner image carried on the photoconductor drum 1 is transferred to the sheet with the transfer unit c4, and is thereafter fixed by being pressurized and heated with the fixing unit c5. Finally, the sheet on which the image has been printed is ejected to the discharge section a.

(Configuration of the Apparatus Main Body and Individual Units)

Figure 2:
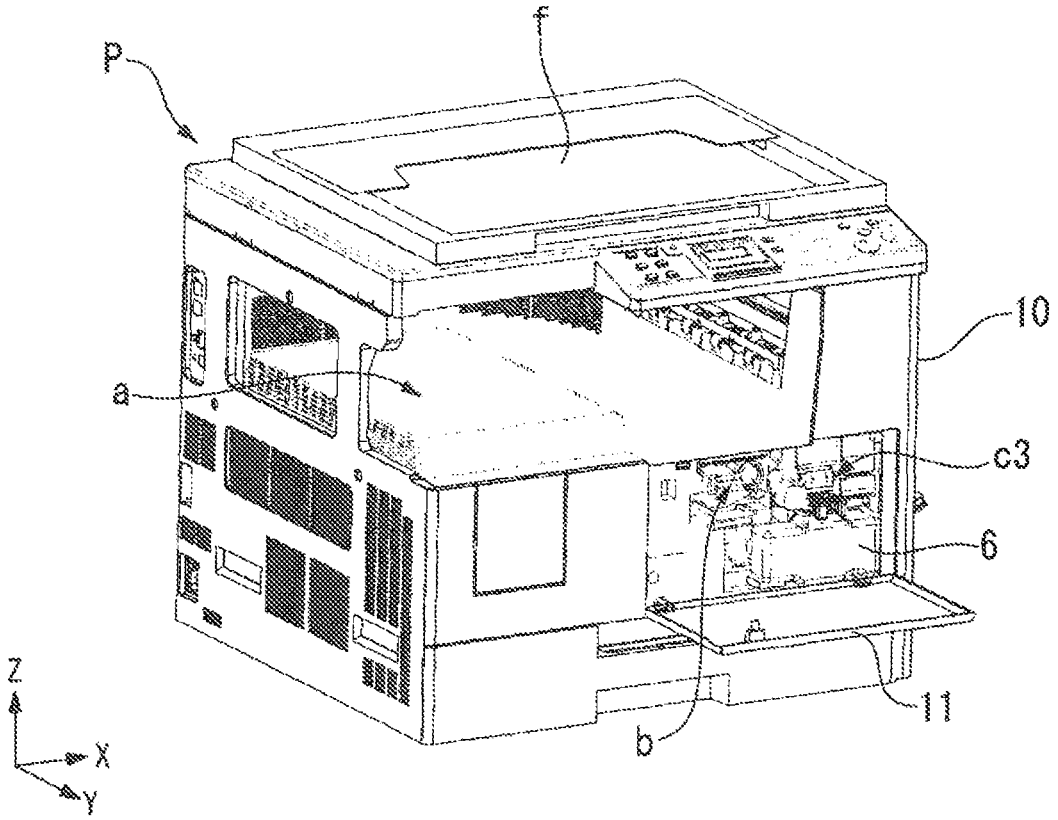
FIG. 2 is a perspective view showing the appearance of an apparatus main body in the embodiment of the present disclosure.
Figure 3:
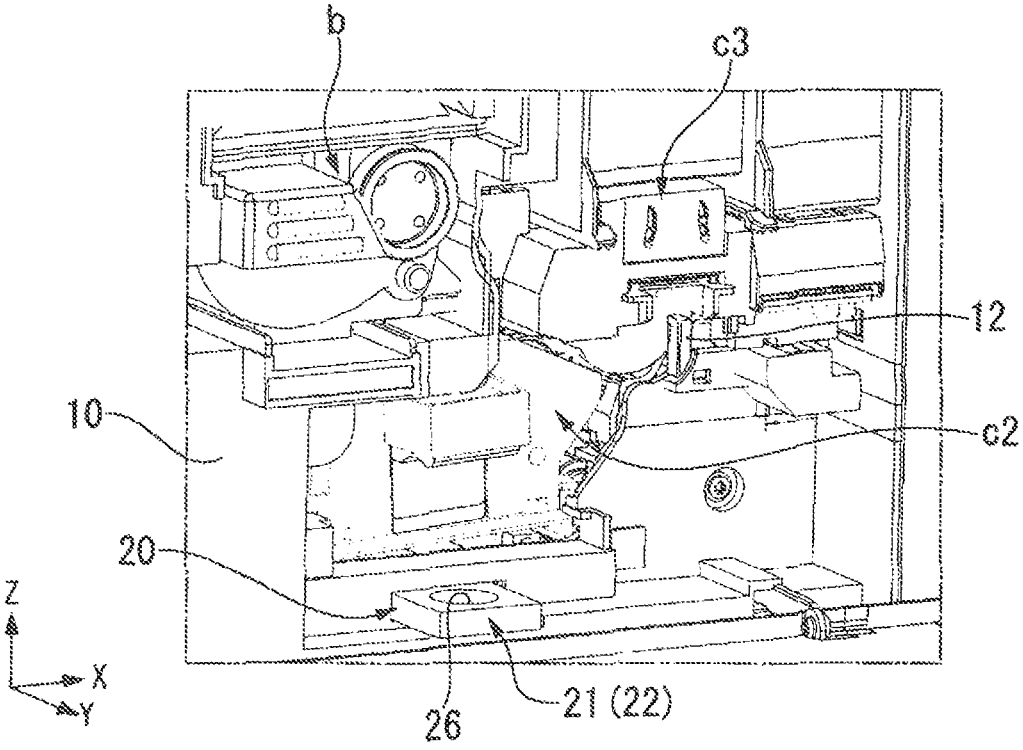
FIG. 3 is an enlarged perspective view showing the main portions in FIG. 2.

FIG. 2 is a perspective view showing the appearance of the apparatus main body 10 in the embodiment of the present disclosure. FIG. 3 is an enlarged perspective view showing the main portions in FIG. 2.

As shown in FIG. 2, a cover 11 on the front side (+Y side) of the apparatus main body 10 is provided to be freely opened and closed. When the cover 11 is opened, as shown in FIG. 3, part of the drum unit c3, part of the toner storage section b and the like are exposed to the outside of the machine. FIG. 3 is a diagram in which a disposal toner bottle 6 shown in FIG. 2 is removed; part of the development unit c2 is exposed to the outside of the machine.

The drum unit c3 and the development unit c2 each can be removed with an unillustrated guide toward the front side with respect to the apparatus main body 10. Hence, the drum unit c3 and the development unit c2 are removed toward the front side, and thus the photoconductor drum 1, the development roller 2 and part of peripheral members can be removed together from the apparatus main body 10.

The removal of the drum unit e3 is restricted by a stopper 12; when the drum unit c3 is removed, it is necessary to release the restriction by the stopper 12. Since the development roller 2 is arranged close to the photoconductor drum 1 (see FIG. 1), when the development unit c2 is removed, it is necessary to separate the development roller 2 from the photoconductor drum 1. The copying machine P of the present embodiment includes a interlocking device 20 that interlocks removal restriction/release so as to remove the units without following the order.

The interlocking device 20 operates an operation member 21 exposed below the development unit c2, and thereby interlocks the removal restriction/release of the drum unit c3 and the development unit c2. The configuration of the interlocking device 20 will be described with reference to FIGS. 4 to 12.

Figure 4:
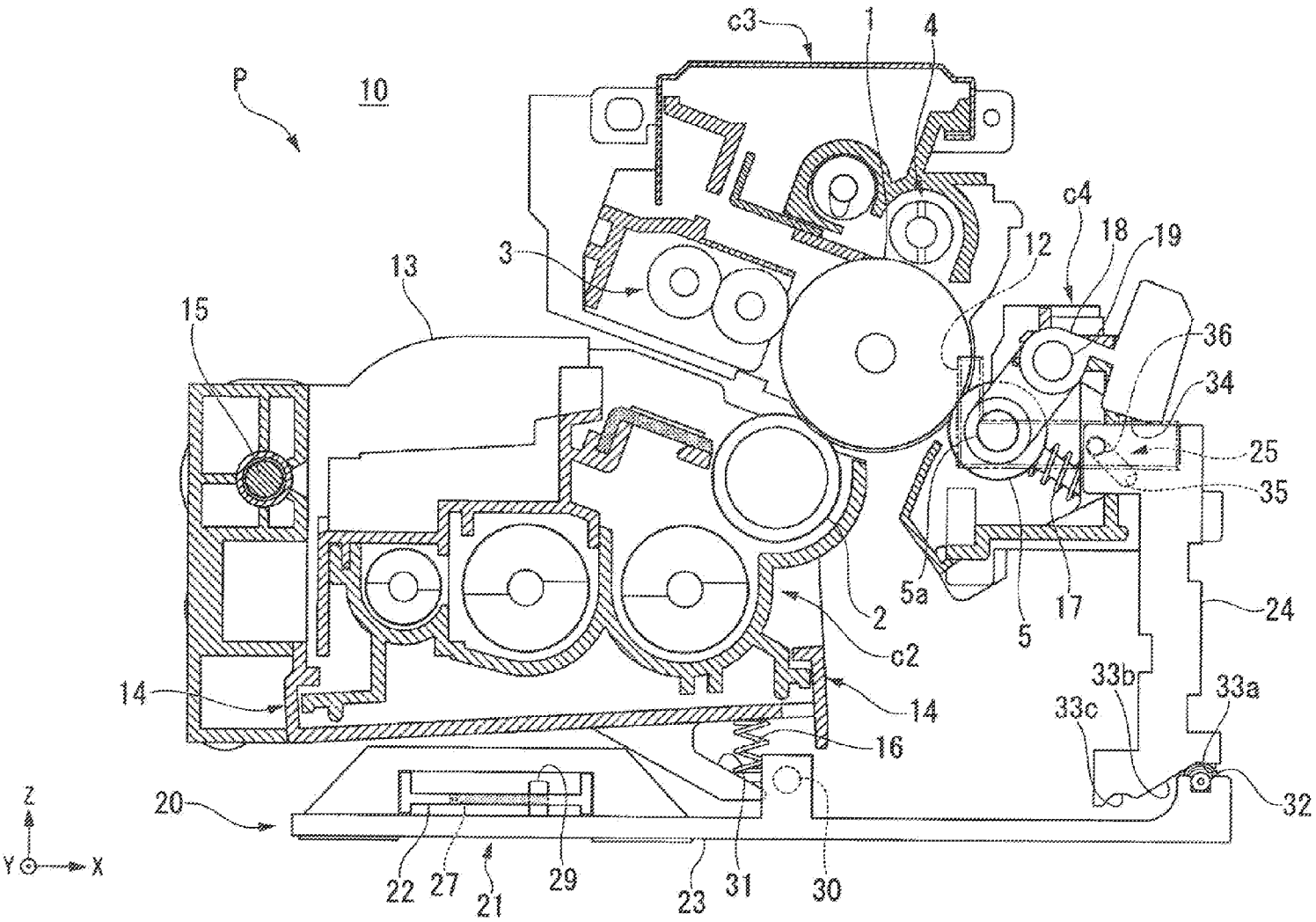
FIG. 4 is a configuration diagram showing the arrangement of individual units when an operation member of an interlocking device in the embodiment of the present disclosure is located in a first position.
Figure 5:
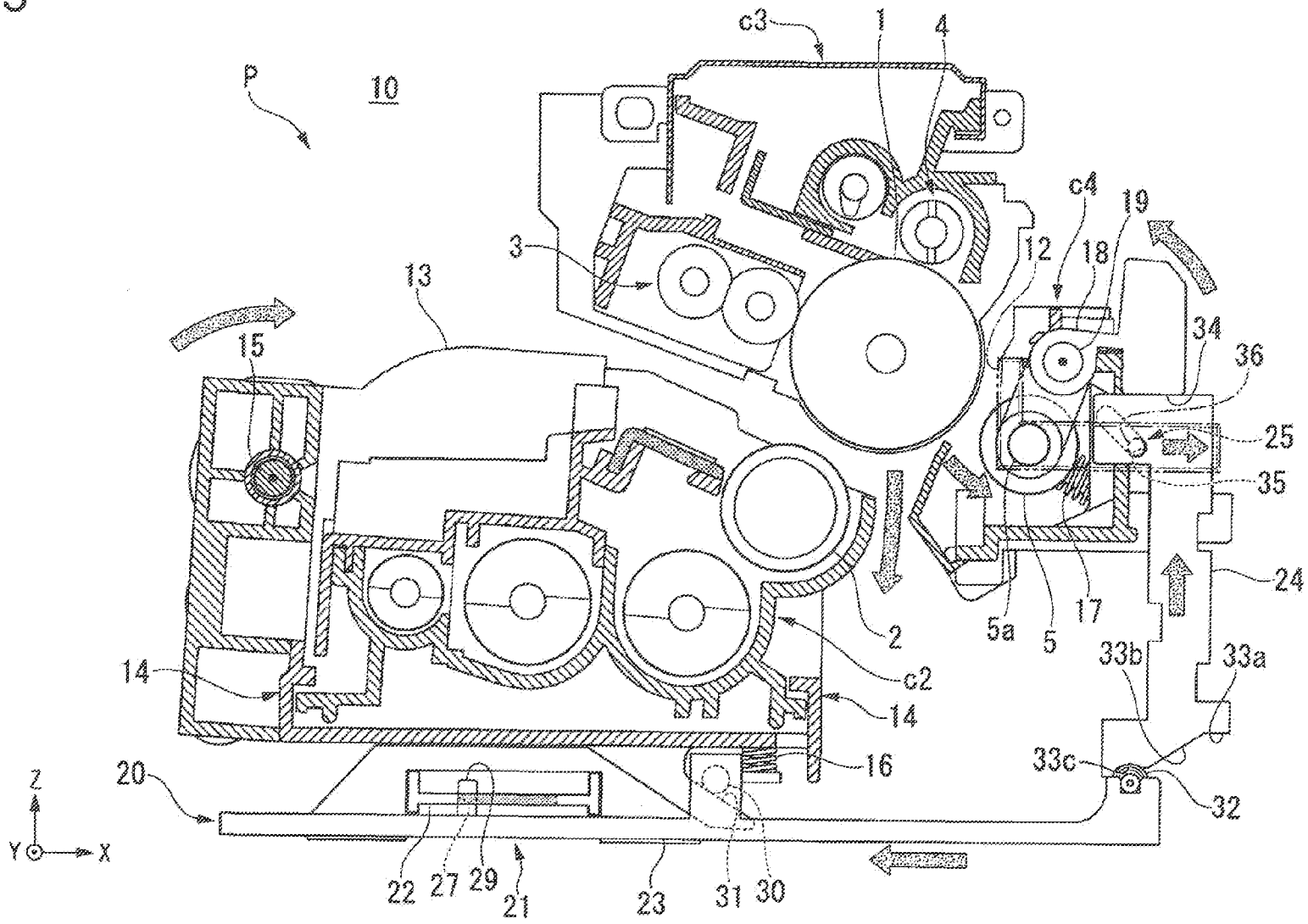
FIG. 5 is a configuration diagram showing the arrangement of the individual units when the operation member of the interlocking device in the embodiment of the present disclosure is located in a second position.
Figure 6:
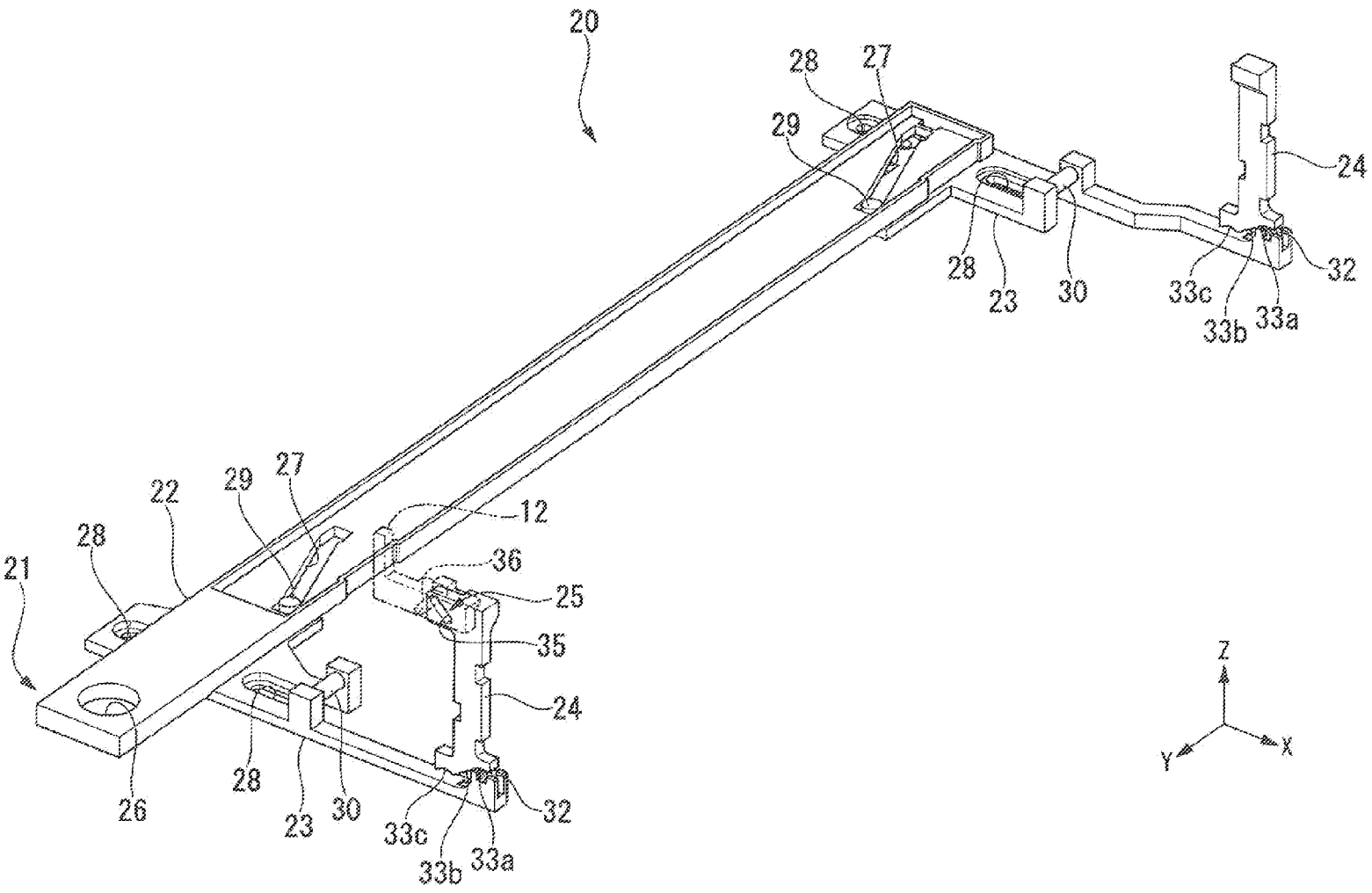
FIG. 6 is a perspective view showing the appearance of the operation member located in the first position in the embodiment of the present disclosure.
Figure 7:
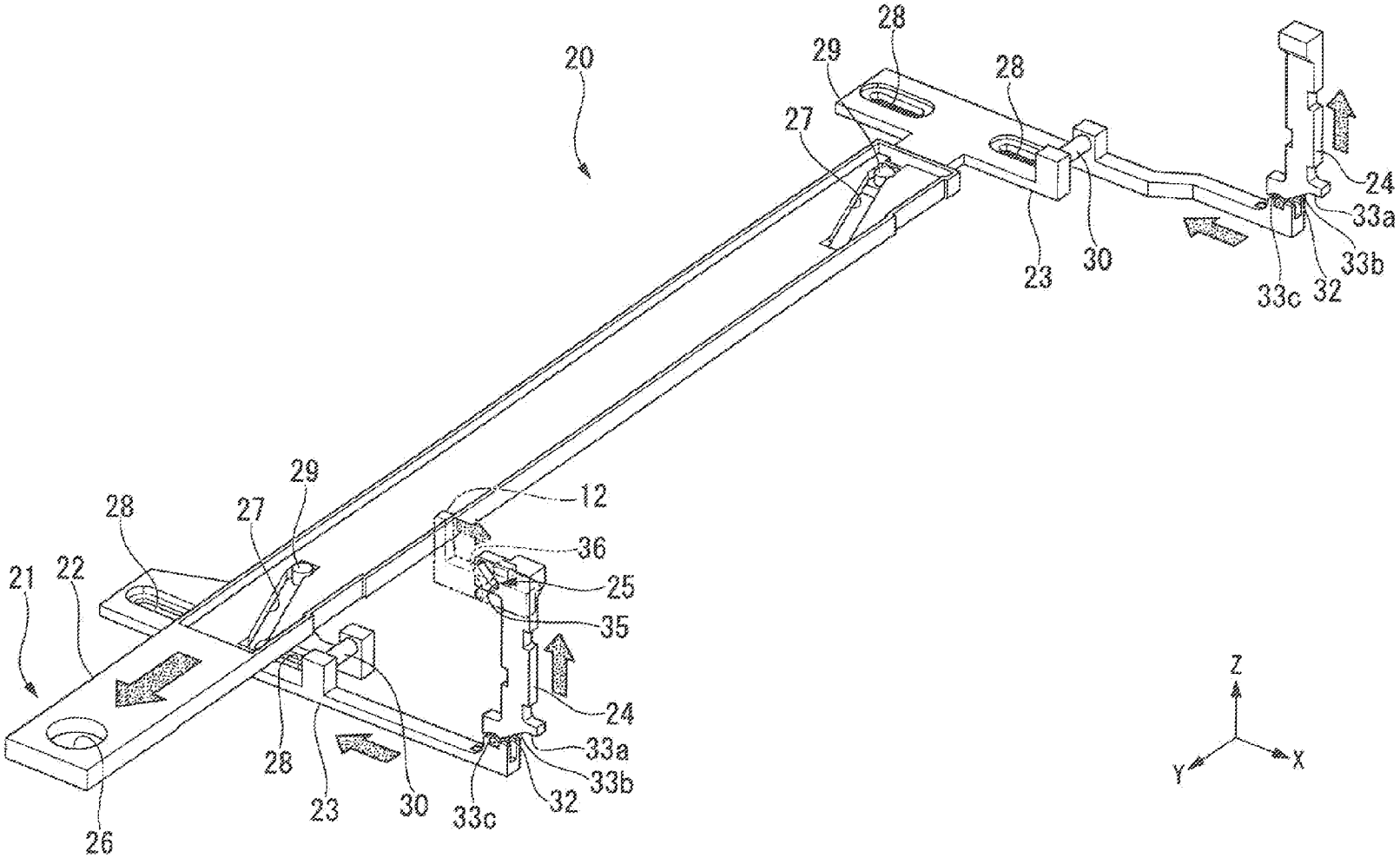
FIG. 7 is a perspective view showing the appearance of the operation member located in the second position in the embodiment of the present disclosure.

FIG. 4 is a configuration diagram showing the arrangement of individual units when an operation member 21 of the interlocking device 20 in the embodiment of the present disclosure is located in a first position. FIG. 5 is a configuration diagram showing the arrangement of the individual units when the operation member 21 of the interlocking device 20 in the embodiment of the present disclosure is located in a second position. FIG. 6 is a perspective view showing the appearance of the operation member 21 located in the first position in the embodiment of the present disclosure. FIG. 7 is a perspective view showing the appearance of the operation member 21 located in the second position in the embodiment of the present disclosure.

Figure 8:
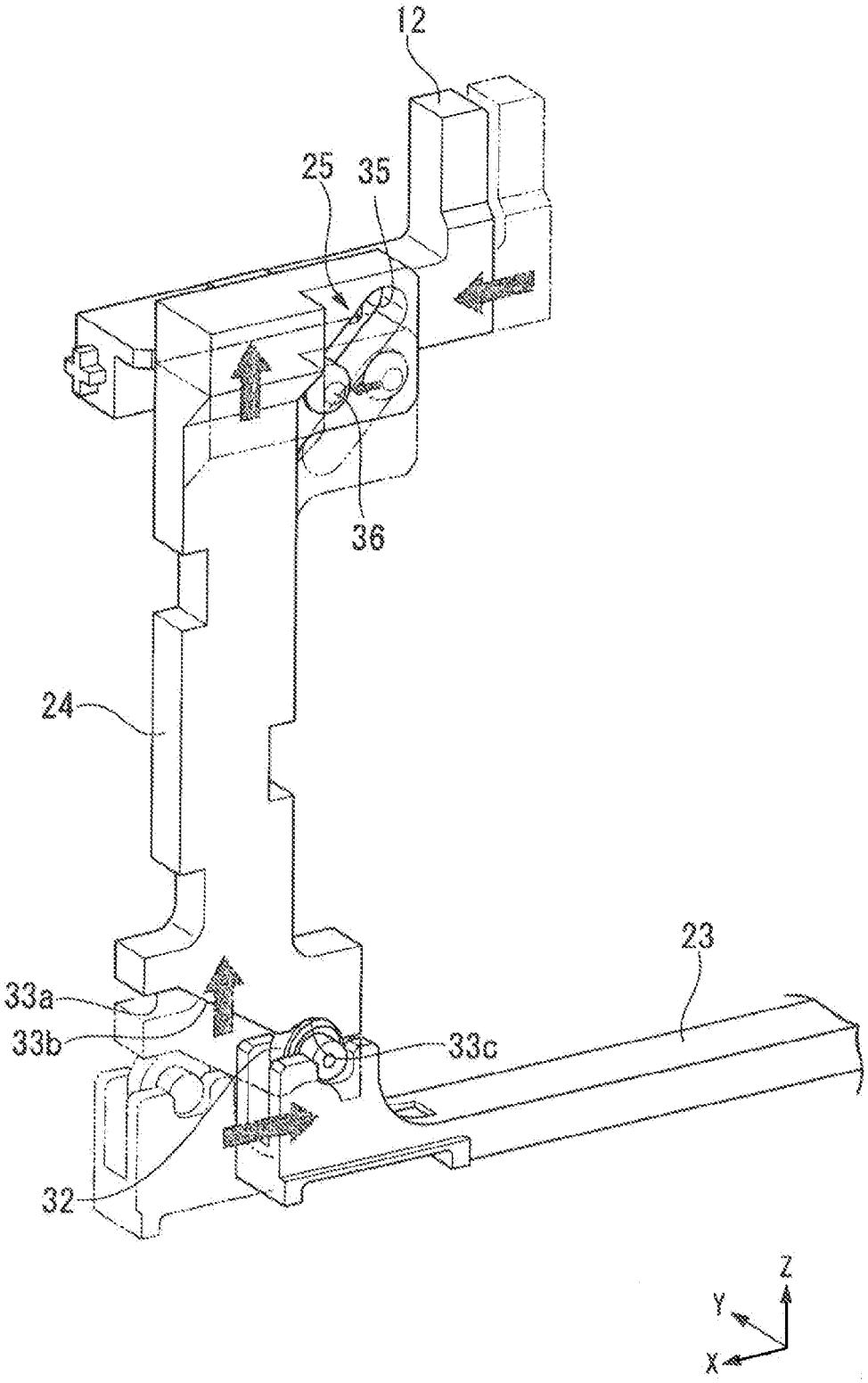
FIG. 8 is an enlarged perspective view showing the configuration of a slide unit of the operation member in the embodiment of the present disclosure.
Figure 9:
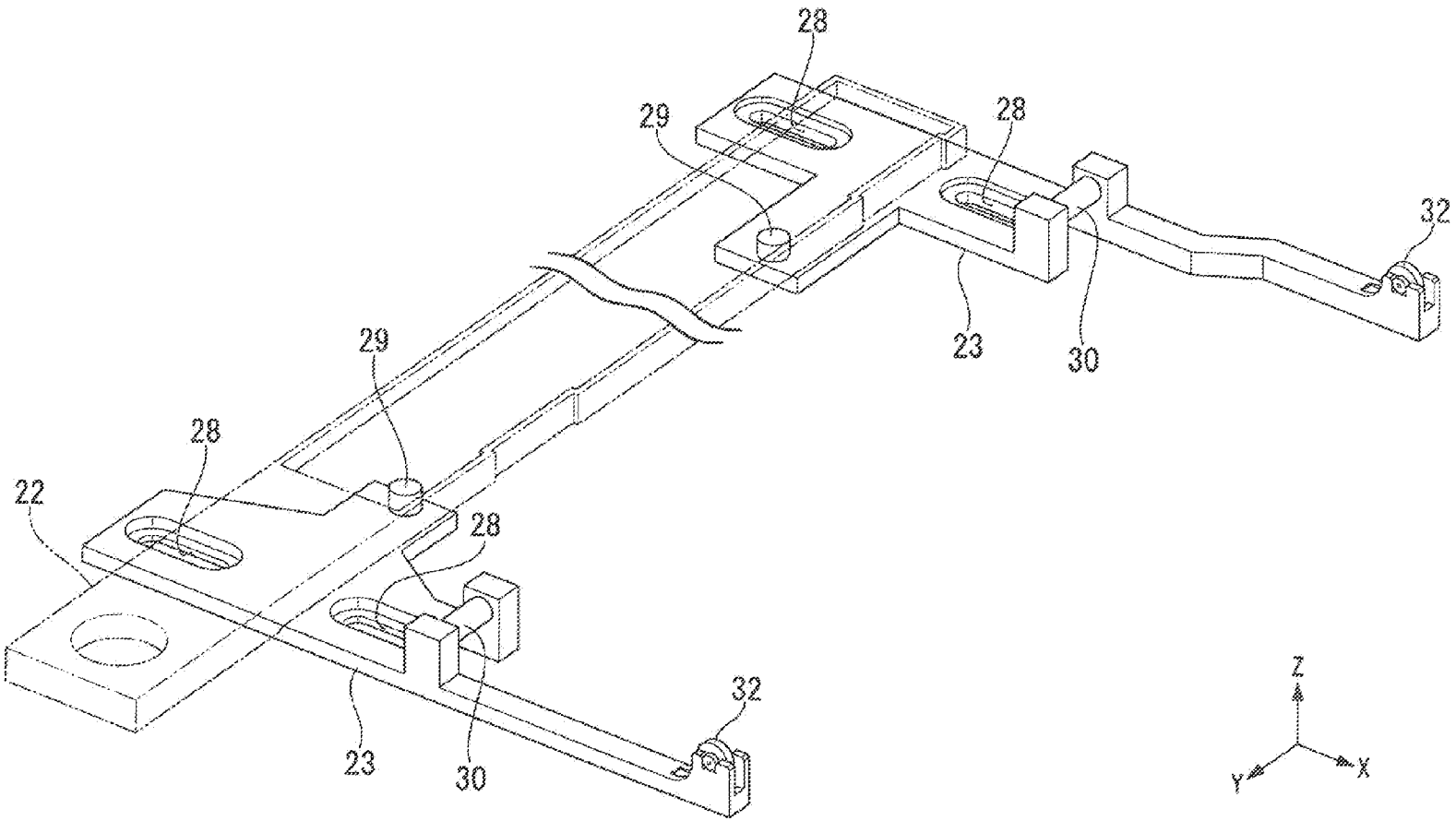
FIG. 9 is a perspective view showing the configuration of second members of the operation member in the embodiment of the present disclosure.
Figure 10:
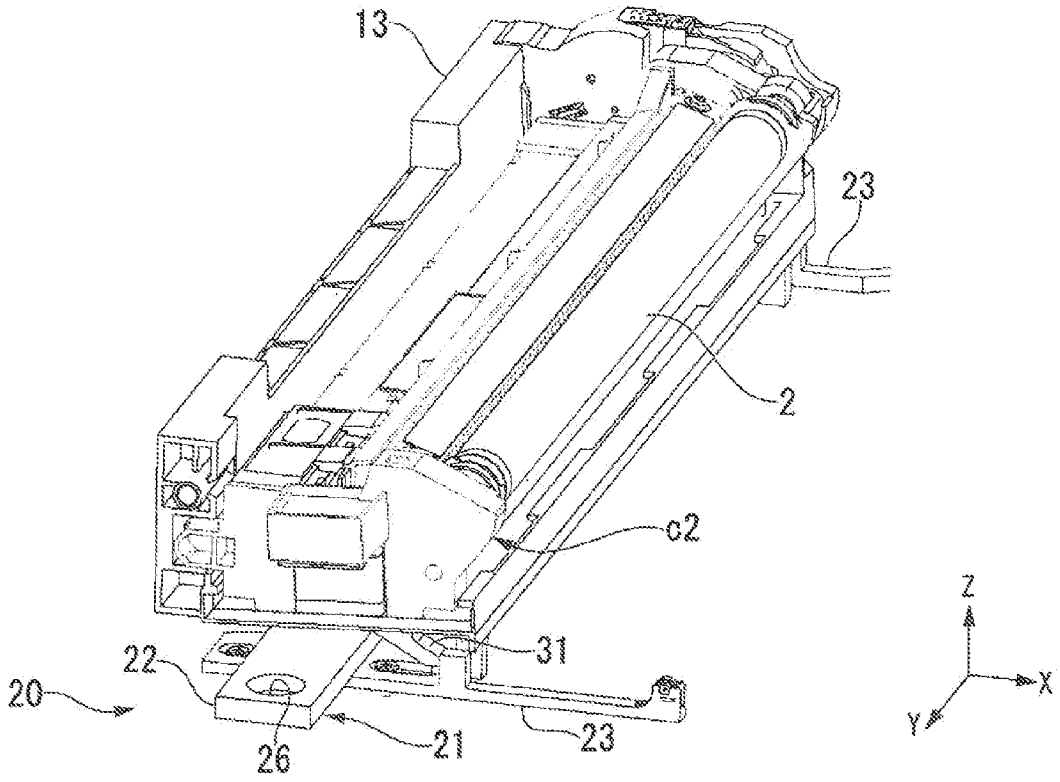
FIG. 10 is a perspective view showing the arrangement of a pressing unit on the operation member in the embodiment of the present disclosure.
Figure 11:
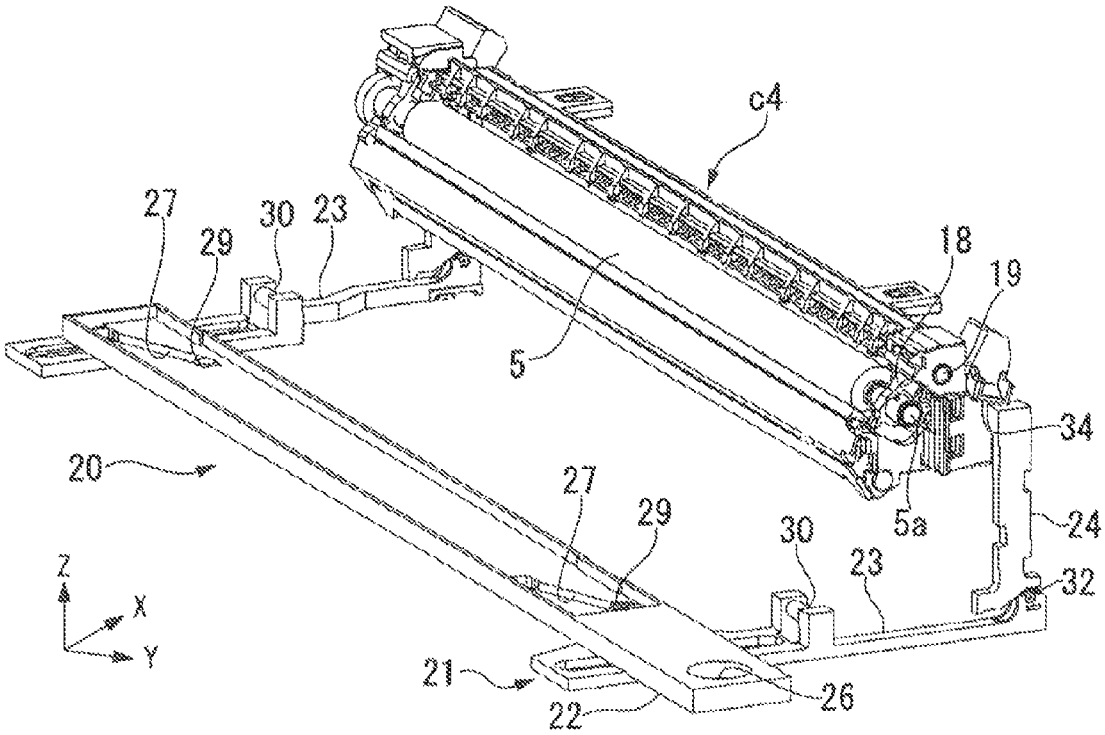
FIG. 11 is a perspective view showing the arrangement of the transfer unit on the operation member in the embodiment of the present disclosure.
Figure 12:
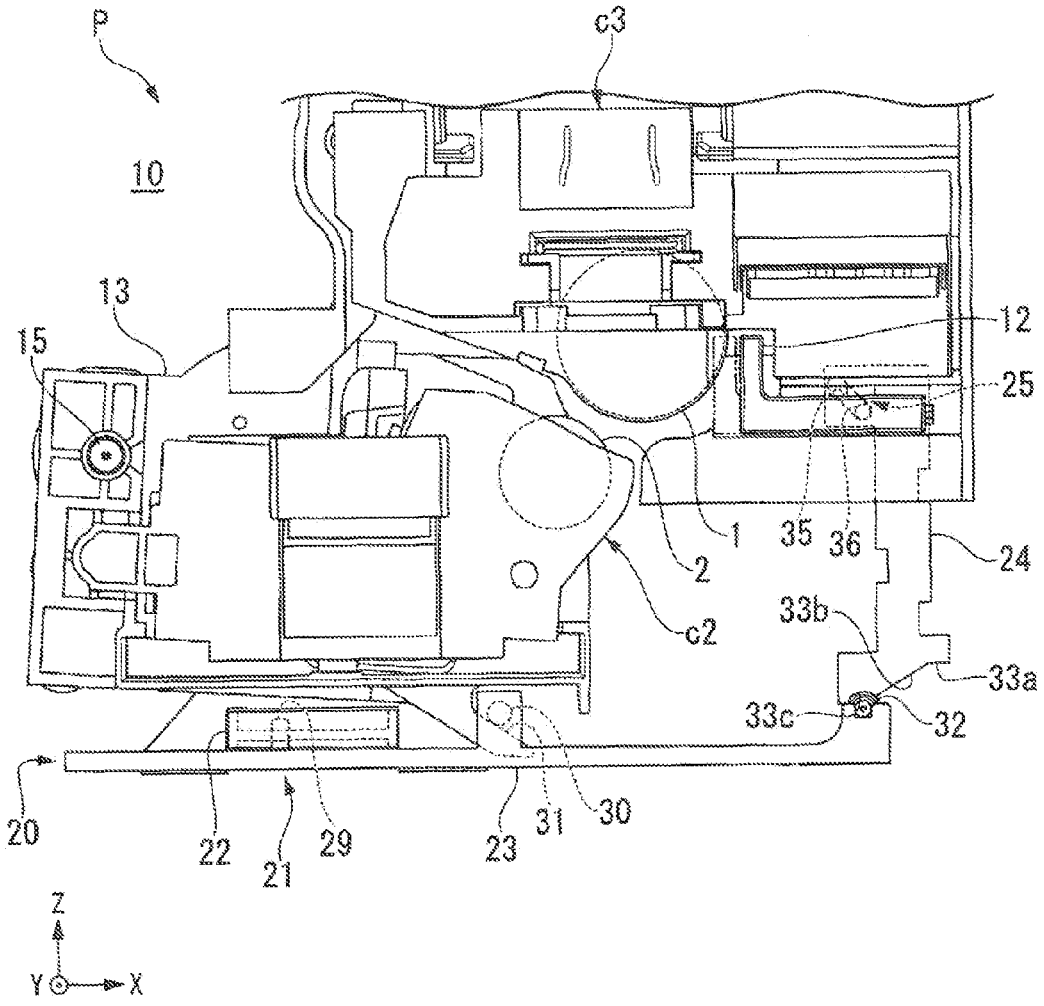
FIG. 12 is an appearance diagram showing a state where the removal restriction on a drum unit is released in the embodiment of the present disclosure.

FIG. 8 is an enlarged perspective view showing the configuration of a slide unit 25 of the operation member 21 in the embodiment of the present disclosure. FIG. 9 is a perspective view showing the configuration of second members 23 of the operation member 21 in the embodiment of the present disclosure. FIG. 10 is a perspective view showing the arrangement of a pressing unit 13 on the operation member 21 in the embodiment of the present disclosure. FIG. 11 is a perspective view showing the arrangement of the transfer unit c4 on the operation member 21 in the embodiment of the present disclosure. FIG. 12 is an appearance diagram showing a state where the removal restriction on the drum unit c3 is released in the embodiment of the present disclosure.

As shown in FIG. 4, when the drum unit c3 is fitted into the apparatus main body 10, the development unit c2 that has the development roller 2 for developing the toner image and the transfer roller 5 that transfers the toner image on the photoconductor drum 1 to the predetermined sheet member are arranged opposite the photoconductor drum 1 in the radial direction. When the drum unit c3 is fitted into the apparatus main body 10, the stopper 12 is arranged in the direction (Y axis direction) in which the unit is removed.

The stopper 12 is formed in the shape of the letter L; the stopper 12 is provided freely movably between a restriction position where the removal of the drum unit c3 is restricted as shown in FIG. 4 and a release position where the restriction of the removal of the drum unit c3 is released. As shown in FIG. 4, the stopper 12 located in the restriction position is exposed to the removal passage of the drum unit c3, and can be locked on the drum unit c3 in the removal direction (Y axis direction). On the other hand, as shown in FIG. 5, the stopper 12 located in the release position is retracted from the removal passage of the drum unit c3.

The development unit c2 is incorporated in the pressing unit 13. The pressing unit 13 includes an engagement portion 14 which incorporates the development unit c2 such that the development unit c2 is freely removed in the same direction (Y axis direction) as the removal direction of the drum unit c3. In the pressing unit 13, the development unit c2 is freely moved between a pressing position where the development roller 2 is pressed onto the photoconductor drum 1 as shown in FIG. 4 and a pressing release position where the development roller 2 is separated from the photoconductor drum 1 to release the pressing as shown in FIG. 5.

As shown in FIG. 4, the pressing unit 13 includes a rotation shaft (first shaft) 15 that rotates the development unit c2. The rotation shaft 15 is supported freely rotatably in an unillustrated hole portion of the apparatus main body 10. Hence, the development unit c2 is freely rotated about the rotation shaft 15 that extends in the removal direction (Y axis direction). On the lower portion of the pressing unit 13, a pressing spring (first force application member) 16 is provided. The pressing spring 16 applies, to the pressing unit 13, a force acting from the pressing release position to the pressing position.

The transfer roller 5 is provided so as to be freely moved between a second pressing position where the transfer roller 5 is pressed onto the photoconductor drum 1 as shown in FIG. 4 and a second pressing release position where the transfer roller 5 is separated from the photoconductor drum 1 to release the pressing as shown in FIG. 5. The transfer roller 5 is pressed by a pressing spring (second force application member) 17, and thereby receives a force acting from the second pressing release position to the second pressing position.

The transfer unit c4 having the transfer roller 5 includes lever members 18 that engage with the shaft 5*a* of the transfer roller 5. The lever member 18 includes a rotation shaft (second shaft) 19. Hence, the transfer roller 5 is freely rotated about the rotation shaft 19 that extends in the removal direction (Y axis direction).

The interlocking device 20 interlocks the movements of the stopper 12 and the pressing unit 13 and furthermore the transfer roller 5. The interlocking device 20 includes the operation member 21 that is freely moved between: the first position (see FIG. 4) where, in an interlocked manner, the stopper 12 is located in the restriction position, the pressing unit 13 is located in the pressing position and the transfer roller 5 is located in the second pressing position; and the second position (see FIG. 5) where, in an interlocked manner, the stopper 12 is located in the release position, the pressing unit 13 is located in the pressing release position and the transfer roller 5 is located in the second pressing release position.

The operation member 21 includes: a first member 22 that can be removed from the apparatus main body 10; the second members 23 that rotate the pressing unit 13 about the rotation shaft 15 in coordination with the first member 22; third members 24 that rotate the transfer roller 5 about the rotation shaft 19 in coordination with the second members 23; and the slide unit 25 that slides the stopper 12 in coordination with the third members 24.

As shown in FIG. 6, the first member 22 is a plate-shaped member that extends in the backward direction (Y axis direction) of the apparatus main body 10. In the front side of the first member 22, a holding portion 26 is provided. As shown in FIGS. 6 and 7, the first member 22 is freely moved by an unillustrated guide in the Y axis direction.

The first member 22 has grooves 27 that extend in a direction intersecting a movement direction (Y axis direction). The grooves 27 are provided in the front side (+Y side) and the back side (−Y side) parallel to each other. As the groove 27 extends to the back side, it extends to the left side (−X side).

The second members 23 are provided as a pair in the front side (+Y side) and the back side (−Y side) of the first member 22 parallel to each other. As shown in FIG. 9, the second members 23 are provided below the first member 22. The second members 23 have guide grooves 28 that extend in a direction (X axis direction) perpendicular to the removal direction. Unillustrated screws are inserted into the guide grooves 28, and the second members 23 are freely moved in the X axis direction. In the second members 23, pins 29 arranged in the grooves 27 of the first member 22 are provided so as to stand.

Hence, as the first member 22 is removed to +Y side as shown in FIG. 7, the pin 29 slides along the groove 27, and the second member 23 is interlocked with the first member 22 to be moved to −X side. On the contrary, as the first member 22 is pressed to −Y side, the pin 29 slides along the groove 27, and the second member 23 is interlocked with the first member 22 to be moved to +X side (see FIG. 6).

The second members 23 include shafts 30 that are interlocked with the first member 22 to rotate the pressing unit 13 about the rotation shaft 15. The shaft 30 is provided so as to extend in the Y axis direction. As shown in FIG. 4, hooks 31 that can engage with the shafts 30 are provided integrally with the lower portion of the pressing unit 13. As the hook 31 extends to +X side, it inclines downward. The arrangement of the pressing unit 13 with respect to the second members 23 is as shown in FIG. 10.

When the operation member 21 is located in the first position, as shown in FIG. 4, the shafts 30 do not engage with the shafts 30. On the other hand, when the operation member 21 is located in the second position, as shown in FIG. 5, the shafts 30 engage with the hooks 31, and thus the pressing unit 13 is pressed down against the force applied by the pressing spring 16. Specifically, when the shafts 30 are moved to −X side, the development unit c2 is rotated together with the pressing unit 13 about the rotation shaft 15, and the development roller 2 is separated from the photoconductor drum 1, with the result that the pressed state is released.

As shown in FIG. 9, the second members 23 have support rollers 32 at the end portions on +X side. The support rollers 32 are supported freely rotatably about a shaft extending in the Y axis direction. As shown in FIG. 6, the support rollers 32 support the third members 24.

The third member 24 is a bar-shaped member that extends in a vertical direction (Z axis direction). The third members 24 are provided, according to the second members 23, as a pair, in the front side (+Y side) and the back side (−Y side) parallel to each other.

As shown in FIGS. 6 and 7, the third members 24 are freely moved by an unillustrated guide in the Z axis direction. As shown in FIG. 4, the lower end of the third member 24 is supported by the support roller 32. The lower end portion of the third member 24 includes a flat surface portion 33*a*, an inclination surface portion 33*b* and a recess portion 33*c*. The flat surface portion 33*a* is present above the recess portion 33*c*; the inclination surface portion 33*b* is provided between the flat surface portion 33*a* and the recess portion 33*c*.

As shown in FIG. 11, the lever member 18 has a contact portion 34 (a contact portion 34 on the back side (−Y side) is not shown) that protrudes in the Y axis direction. The upper end of the third member 24 is provided in such a position that the upper end can make contact with the contact portion 34 of the lever member 18 in the Z axis direction.

When the operation member 21 is located in the first position, as shown in FIG. 4, the flat surface portion 33*a* of the third member 24 is supported by the support roller 32. On the other hand, when the operation member 21 is located in the second position, as shown in FIG. 5, the recess portion 33*c* of the third member 24 is supported by the support roller 32, and thus the transfer roller 5 is rotated against the force applied by the pressing spring 17.

Specifically, when the second member 23 is moved to −X side, the support roller 32 is rotated to move the lower end of the third member 24, and the supporting position is moved from the flat surface portion 33*a* through the inclination surface portion 33*b* to the recess portion 33*c*. Then, the third member 24 is moved to +Z side, the upper end of the third member 24 presses up the contact portion 34, the transfer roller 5 is rotated together with the lever members 18 about the rotation shaft 19, and the transfer roller 5 is separated from the photoconductor drum 1, with the result that the pressed state is released.

As shown in FIG. 6, in the third member 24 on the front side (+Y side), the slide unit 25 that slides the stopper 12 is provided. As shown in FIGS. 6 and 7, the stopper 12 is freely moved by an unillustrated guide in the X axis direction. As shown in FIG. 8, the slide unit 25 includes a groove 35 provided in the third member 24 and a pin 36 provided in the stopper 12.

The groove 35 extends in a direction interesting the direction (Z axis direction) in which the third member 24 is moved. As the groove 35 extends to +Z side, it extends to −X side. The pin 36 is provided to stand from the stopper 12 to −Y side, and is arranged in the groove 35. Hence, as the third member 24 is pressed up to +Z side, the pin 36 slides along the groove 35, and the stopper 12 is interlocked with the third member 24 to be moved to +X side.

On the contrary, as the third member 24 is pressed down to −Z side, the pin 36 slides along the groove 35, and the stopper 12 is interlocked with the third member 24 to be moved to −X side (see FIG. 4). Hence, when the operation member 21 is located in the first position, as shown in FIG. 4, the stopper 12 is exposed to the removal passage of the drum unit c3. On the other hand, when the operation member 21 is located in the second position, as shown in FIG. 5, the stopper 12 is retracted from the removal passage of the drum unit c3.

A unit replacement operation in the copying machine P configured as described above will now be described.

When the drum unit c3 and the development unit c2 are removed from the apparatus main body 10, an operator first opens the cover 11 provided on the front side of the apparatus main body 10 as shown in FIG. 2. When the cover 11 is opened, and the disposal toner bottle 6 is removed, as shown in FIG. 3, part (the first member 22) of the operation member 21 of the interlocking device 20 is exposed to the front side of the apparatus main body 10.

Then, the operator moves the operation member 21 from the first position to the second position. Specifically, while the operator is holding the holding portion 26 of the first member 22, the operator removes it to the front side (+Y side) of the apparatus main body 10. When the first member 22 is removed, and the operation member 21 is moved from the first position to the second position, the drum unit c3 and the development unit c2 are freely removed from the apparatus main body 10.

More specifically, when the first member 22 is removed, as shown in FIG. 7, the pin 29 engaging with the groove 27 slides to −X side. Thus, the second member 23 is interlocked with the first member 22 to be moved to −X side. When the second member 23 is moved to −X side, as shown in FIG. 5, the shaft 30 engages with the hook 31, and the pressing unit 13 is pressed down against the force applied by the pressing spring 16. When the pressing unit 13 is pressed down, the development unit c2 is rotated about the rotation shaft 15, and the development roller 2 is separated from the photoconductor drum 1 (the pressing release position).

When the second member 23 is moved to −X side, the support roller 32 is rotated to move the lower end of the third member 24, and supports the recess portion 33*c*. When the recess portion 33*c* is supported, the third member 24 is moved to +Z side, and the upper end of the third member 24 presses up the contact portion 34. When the contact portion 34 is pressed up, the lever member 18 is rotated about the rotation shaft 19, and the transfer roller 5 is separated from the photoconductor drum 1 against the force applied by the pressing spring 17 (the second pressing release position).

When the third member 24 is moved to +Z side, the pin 36 engaging with the groove 35 slides to +X side. Thus, the stopper 12 is moved to +X side (the release position).

As described above, with the interlocking device 20 of the present embodiment, by moving the operation member 21 to the second position, it is possible to simultaneously perform the release of the stopper 12 on the drum unit c3, the pressing release of the development roller 2 onto the photoconductor drum 1 and the pressing release of the transfer roller 5 onto the photoconductor drum 1.

Hence, as shown in FIG. 12, the operator freely removes either or both of the drum unit c3 and the development unit c2 in which the removal restriction is release, without restricting the order.

As described above, in the present embodiment, it is possible to prevent the order of removal of the drum unit c3 and the development unit c2 from being restricted, and to make the unit replacement operation intuitively and easily understood. In the present embodiment, since the pressing release of the transfer roller 5 onto the photoconductor drum 1 is simultaneously performed, for example, it is possible to remove the drum unit c3, for example, without opening and closing the transport cover in the lateral direction of the apparatus main body 10 so as to release the pressing of the transfer roller 5. As described above, the operator can simultaneously move the stopper 12, the pressing unit 13 and the transfer roller 5 by performing an easy and intuitive operation with one operation member 21, and thus it is possible to easily and efficiently perform the unit replacement operation.

On the other hand, when the drum unit c3 and the development unit c2 are fitted into the apparatus main body 10 after maintenance, the operator locates the operation member 21 in the second position, and inserts the drum unit c3 and the development unit c2 into the apparatus main body 10 in the Y axis direction. When the operation member 21 is located in the first position, since the stopper 12 is located in the restriction position, it is possible to prevent the drum unit c3 from being erroneously fitted.

After the insertion of the units, the operator moves the operation member 21 from the second position to the first position. Specifically, while the operator is holding the holding portion 26 of the first member 22, the operator presses it to the back side (−Y side) of the apparatus main body 10. When the first member 22 is pressed thereto, as shown in FIG. 6, the pin 29 engaging with the groove 27 slides to +X side. Thus, the second member 23 is interlocked with the first member 22 to be moved to +X side. When the second member 23 is moved to +X side, as shown in FIG. 4, the engagement of the shaft 30 with the hook 31 is eliminated, and the pressing unit 13 is pressed up by the force applied by the pressing spring 16. When the pressing unit 13 is pressed up, the development unit c2 is rotated about the rotation shaft 15, and the development roller 2 is close to the photoconductor drum 1 (the pressing position).

When the second member 23 is moved to +X side, the support roller 32 is rotated to move the lower end of the third member 24, and supports the recess portion 33*c*. When the recess portion 33*c* is supported, the third member 24 is moved to −Z side, and the pressing up of the contact portion 34 by the upper end of the third member 24 is released. When the pressing up of the contact portion 34 is released, the lever member 18 is rotated about the rotation shaft 19, and the transfer roller 5 is close to the photoconductor drum 1 by the force applied by the pressing spring 17 (the second pressing position).

When the third member 24 is moved to −Z side, the pin 36 engaging with the groove 35 slides to −X side. Thus, the stopper 12 is moved to −X side (the release position).

As described above, when the operation member 21 is moved from the second position to the first position, the restoring force applied by the pressing springs 16 and 17 is utilized, and thus it is possible to return the development roller 2 and the transfer roller 5 to the original positions located with respect to the photoconductor drum 1. Thus, with the interlocking device 20 of the present embodiment, by moving the operation member 21 to the first position, it is possible to simultaneously perform the restriction of the stopper 12 on the drum unit c3, the pressing of the development roller 2 onto the photoconductor drum 1 and the pressing of the transfer roller 5 onto the photoconductor drum 1, with the result that it is possible to perform the unit replacement operation by the simple and intuitive operation of the one operation member 21.

Hence, according to the present embodiment, the copying machine P is provided in which the drum unit c3 having the photoconductor drum 1 and the development unit c2 having the development roller 2 developing the toner image on the photoconductor drum 1 can be removed from the apparatus main body 10, the copying machine P including: the stopper 12 that is freely moved between the restriction position where the removal of the drum unit c3 is restricted and the release position where the restriction of the removal of the drum unit c3 is released; the pressing unit 13 that is freely moved between the pressing position where the development roller 2 is pressed onto the photoconductor drum 1 and the pressing release position where the development roller 2 is separated from the photoconductor drum 1 such that the pressing is released; and the interlocking device 20 that interlocks the movements of the stopper 12 and the pressing unit 13. With this configuration, it is possible to obtain the copying machine P that can easily and efficiently perform the unit replacement operation and that can realize the reduction in downtime and in the operation area.

Although the preferred embodiment of the present disclosure has been described above with reference to the accompanying drawings, the present disclosure is not limited to the above embodiment. The constituent members, the shapes, the combinations and the like described in the above embodiment are illustrative; various modifications are possible without departing from the spirit of the present disclosure based on design requirements and the like.

For example, although in the above embodiment, the copying machine has been illustrated as the image forming apparatus, the present disclosure can be applied to, for example, image forming apparatuses such as printers and facsimile machines.

What is claimed is:

1. An image forming apparatus with removable drum unit in which a drum unit having a photoconductor drum and a development unit having a development roller developing a toner image on the photoconductor drum can be removed from a main body of the apparatus, the image forming apparatus comprising:

a stopper that is movable between a restriction position where the removal of the drum unit is restricted and a release position where the restriction of the removal of the drum unit is released;

a pressing unit that is movable between a pressing position where the development roller is pressed onto the photoconductor drum and a pressing release position where the development roller is separated from the photoconductor drum such that the pressing is released; and a transfer roller that is movable between a second pressing position where the transfer roller is pressed on the photoconductor drum and a second pressing position where the transfer roller is separated from the photoconductor drum such that the pressing is released; and an interlocking device that interlocks the movements of the stopper, the pressing unit and the transfer roller, wherein the interlocking device includes an operation member that is movable between:

a first position where in a interlocked manner, the stopper is located in the restriction position, the pressing unit is located in the pressing position and the transfer roller is located in the second pressing position; and a second position where in an interlocked manner, the stopper is located in the release position, the pressing unit is located in the pressing release position and the transfer roller is located in the second pressing release position, and the operation member includes:

a first member that can be removed from the main body of the apparatus;

a second member that is interlocked with the first member to rotate the pressing unit about a first shaft;

a third member that is interlocked with the second member to rotate the transfer roller about a second shaft; and a slide unit that is interlocked with the third member to slide the stopper.

2. The image forming apparatus of claim 1, further comprising:

a first force application member that applies, to the pressing unit, a force acting from the pressing release position to the pressing position; and a second force application member that applies, to the transfer roller, a force acting from the second pressing release position to the second pressing position, wherein, when the operation member is moved from the first position to the second position, the operation member moves the pressing unit and the transfer roller against the force.

* * * * *